US005832696A

United States Patent [19]

Nagy et al.

[11] Patent Number: 5,832,696

[45] Date of Patent: Nov. 10, 1998

[54] METHOD AND APPARATUS FOR PACKAGING COMPRESSIBLE INSULATION MATERIAL

[75] Inventors: Gabor Nagy, Clifton, N.J.; Kenneth M. Johnson, Greer, S.C.; James W. Scott; Raymond V. Monnin, both of Newark, Ohio

[73] Assignee: Owens Corning Fiberglas Technology, Inc., Summit, Ill.

[21] Appl. No.: 309,710

[22] Filed: Sep. 21, 1994

[51] Int. Cl.[6] ..... B65B 51/18; B65B 63/04

[52] U.S. Cl. ..... 53/430; 53/438; 53/439; 53/118; 53/529; 242/541.3

[58] Field of Search ..... 53/116, 118, 430, 53/436, 438, 439, 528, 529, 530; 242/541.3, 541.4

[56] References Cited

U.S. PATENT DOCUMENTS

| | | | |
|---|---|---|---|
| 2,789,406 | 4/1957 | Mosier | 53/118 |
| 3,220,583 | 11/1965 | Robertson . | |
| 3,521,424 | 7/1970 | Wirfel | 53/430 X |
| 3,964,232 | 6/1976 | Bender et al. | 53/438 X |
| 3,964,235 | 6/1976 | Miller et al. | 53/118 |
| 3,991,538 | 11/1976 | Finn et al. | 53/438 X |
| 4,056,918 | 11/1977 | Matsumoto | 53/118 |
| 4,114,530 | 9/1978 | Miller | 53/118 X |
| 4,164,177 | 8/1979 | Canfield | 53/118 X |
| 4,203,273 | 5/1980 | Edgecombe . | |
| 4,583,697 | 4/1986 | Bichot et al. | 242/541.3 X |
| 4,602,471 | 7/1986 | Gray et al. | 53/430 |
| 4,608,807 | 9/1986 | Skripalle | 53/430 X |
| 4,711,067 | 12/1987 | Magni | 53/439 |
| 4,921,183 | 5/1990 | Saukkonen et al. | 242/541.3 |
| 5,132,153 | 7/1992 | Hendriks . | |
| 5,228,572 | 7/1993 | Hendriks . | |
| 5,425,512 | 6/1995 | Bichot et al. . | |

FOREIGN PATENT DOCUMENTS

| | | |
|---|---|---|
| 2255552 | 11/1992 | United Kingdom . |
| 9412417 | 6/1994 | WIPO . |

*Primary Examiner*—Lowell A. Larson
*Assistant Examiner*—Daniel Moon
*Attorney, Agent, or Firm*—C. Michael Gegenheimer; Curtis B. Brueske

[57] ABSTRACT

A method of packaging compressible insulation material includes feeding insulation material into contact with a mandrel, rolling up the insulation material on the mandrel to form an insulation roll, applying pressure on the insulation material, during the rolling of the insulation material, with a pair of opposed belts which are adapted to contact the roll being formed with an increasing area of contact as the diameter of the roll increases, and increasing tension on the belts as the diameter of the roll increases in order to maintain a substantially constant pressure on the insulation material.

15 Claims, 4 Drawing Sheets

METHOD AND APPARATUS FOR PACKAGING COMPRESSIBLE INSULATION MATERIAL

TECHNICAL FIELD

This invention relates to packaging compressible insulation material for shipping and storage. More particularly, this invention relates to rolling up compressible insulation material to a highly compressed condition for efficient shipping and storing.

BACKGROUND ART

Insulation products are usually comprised of a fibrous or cellular matrix which inhibits heat transfer by solid conduction and radiation, and also provides or defines cells or voids to limit convective heat transfer. Accordingly, these products necessarily contain a high percentage of air. In order to efficiently transport and store the insulation products from the manufacturing site to the ultimate destination, it is desirable to significantly compress the insulation material. Care must be taken not to overcompress the insulation because that would lead to loss of the ability to recover the thickness needed for insulation value when the packaging is removed. Fiberglass insulation products are typically packaged either as flat or folded batts in bags, or as rolls of long insulation blankets.

Existing glass fiber insulation packaging machines for rolling up fibrous insulation products into rolls are of two general types. The first employs a mandrel to which the leading edge of the insulation blanket is attached for rolling up. These machines are somewhat deficient in that they typically overcompress the leading portion of the blanket, resulting in loss of insulation value. The other machine for insulation rolls is the belt roll-up machine, which uses a belt which is wrapped around the insulation roll as it is being rolled up. The belt roll-up has a series of rollers defining the path of the belt, and allowing the loop of the belt to expand to accommodate the growing roll during the packaging process. The belt roll-up is deficient in that it is difficult to accurately control the compressive forces applied to the insulation material during roll-up, resulting in improperly compressed rolls of insulation, i.e., overcompressed or undercompressed. Further, both the belt roll-up and the mandrel machines are limited in the amount of compression, and hence the density, in the ultimate rolled insulation package.

DISCLOSURE OF INVENTION

The invention provides for an insulation roll-up machine which overcomes the defects of conventional machines by applying a generally constant compressive force during the roll up of the insulation material. The insulation material is rolled up on a mandrel and is contacted by a traveling belt, and preferably a pair of opposed belts, the tension of which is increased during the rolling up process.

According to this invention, there is provided method of packaging compressible insulation material comprising feeding insulation material into contact with a mandrel, rolling up the insulation material on the mandrel to form an insulation roll, applying pressure on the insulation material, during the rolling of the insulation material, with a traveling belt which is adapted to contact the roll being formed with an increasing area of contact as the diameter of the roll increases, and increasing tension on the belt as the diameter of the roll increases in order to maintain a substantially constant pressure on the insulation material. Preferably, there are two opposed belts, the tension of which is increased to maintain a substantially constant pressure on the insulation material.

The use of two opposed belts helps drive the insulation into a roll around the mandrel, while controlling the pressure on the roll. By increasing the tension on the belts as the diameter of the roll increases, the insulation roll will be highly compressed without overcompressing the leading portion of the insulation blanket. It is desirable to provide a constant pressure or hoop stress on the insulation material as the roll grows in size. By increasing the tension in the belt in a fashion roughly proportional to the diameter of the roll, the hoop stress can be maintained substantially constant.

In a specific embodiment of the invention, the belts are mounted for travel around at least three rollers, and the tension in the belts is controlled by the movement of at least one of the rollers. Controlled movement of the moveable roller changes the path of the belts, thereby modifying the tension in the belts. Generally, the pressure applied to the insulation material by the belts is proportional to the tension in the belts. In a specific embodiment of the invention, the tension is increased from an initial tension to a final tension, the final tension being within the range of from about 1.2 to about 2.0 times the initial tension as the diameter of the roll increases. Preferably, the final tension is about 1.7 times the initial tension.

In another embodiment of the invention, the belts are engaged by deflector rollers to increase the angle of wrap of the belt around the insulation material. The deflector rollers change the path of the belts so that they are forced to travel a longer distance around the circumference of the roll being formed on the mandrel. Preferably, the deflector roller is engaged with the belt for less than one-half of the length of the time period during which the insulation material is being rolled up. After this time the roll has reached a size for the angle of wrap to be sufficient to enable the tension of the belt to control the pressure on the roll being formed on the mandrel.

In a preferred embodiment of the invention the step of engaging the deflector roller is carried out during the first ½ of the packaging cycle. Most preferably, the step of engaging the deflector roller is carried out during the first ⅓ of the packaging cycle.

According to this invention, there is also provided apparatus for packaging compressible insulation material comprising a mandrel mounted for rotation, and adapted to roll up insulation material into a roll, a pair of opposed belts adapted to contact the roll being formed on the mandrel to apply pressure to the roll, the belts being positioned so that they contact the roll being formed with an increasing area of contact as the diameter of the roll increases, and means for increasing tension on the belts as the diameter of the roll increases in order to maintain a substantially constant pressure on the insulation material.

BEST MODE FOR CARRYING OUT THE INVENTION

The invention will be described in terms of packaging fiberglass insulation material. It is to be understood that the method and apparatus of the invention can be used to package insulation material of other fibrous material, such as rockwool fibers or polymers, or other non-fibrous insulation material such as compressible foams. The insulation material most suitable for use with the invention is light density fiberglass building insulation having a density within the range of from about 0.3 to about 0.7 pounds per cubic foot. The invention can be employed using rolls of rolled up batts as well as rolls of a continuous insulation blanket.

Figure 1:
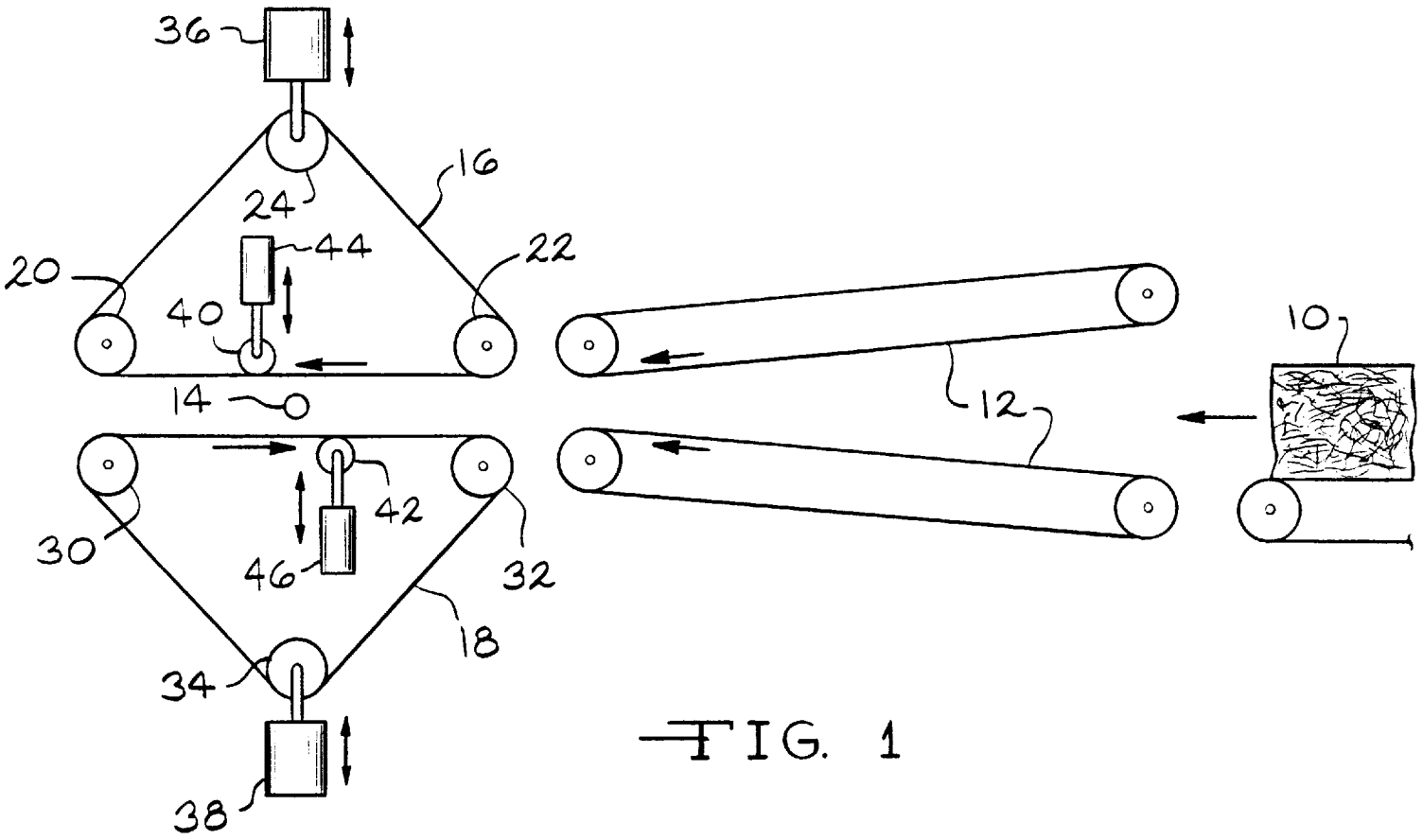
FIG. 1 is a schematic cross-sectional view in elevation of apparatus for packaging compressible insulation material according to the invention.

Referring to FIG. 1, it can be seen that insulation material, such as fiberglass blanket 10, can be introduced to the apparatus of the invention by means of any suitable conveyor system, such as precompression conveyors 12. The precompression conveyors can be gradually converging to slowly evacuate the air from the blanket.

The primary apparatus for rolling up the blanket is rotatably mounted mandrel 14 and opposed belts 16 and 18. The upper and lower belts are mounted to travel in opposite directions as they contact the insulation blanket, and to press on the insulation blanket to assure that the roll has proper compression. The upper belt is mounted for travel around three upper belt rollers 20, 22 and 24, respectively, while the lower belt is mounted for travel around three lower belt rollers, 30, 32 and 34, respectively. Upper belt roller 24 is mounted for vertical movement and can be moved vertically by the action of any suitable means, such as pneumatic apparatus 36. It is to be understood that numerous other orientations or methods can be employed to control tension in the belts. Similarly, lower belt roller 34 can be adapted to be moved vertically downward by pneumatic cylinder 38. The belts can be of any type suitable for continuously applying force and direction to the insulation material, such as wire mesh, canvas and perforated rubber belts.

As the roll of insulation grows in size, the increased angle of wrap around the insulation roll increases the force applied to all the rollers, and therefore tends to increase the tension in the belt. The upper and lower belt rollers are mounted for movement to accommodate changes in the path of the belt, and the amount of resistance to the force applied to the upper and lower rollers is controlled by the positioning of the upper and lower rollers by pneumatic cylinders 36 and 38. The amount of resistance to movement controls the tension, and hence the pressure on the insulation material being rolled up.

Figure 3:
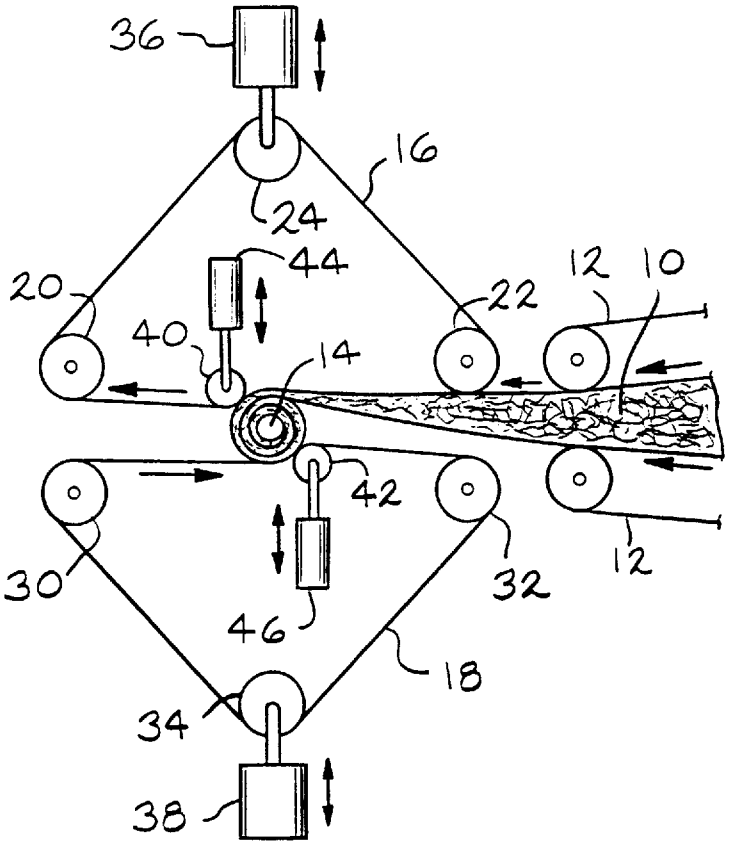
FIG. 3 is a view similar to FIG. 2, in which the insulation material is being rolled up.
Figure 2:
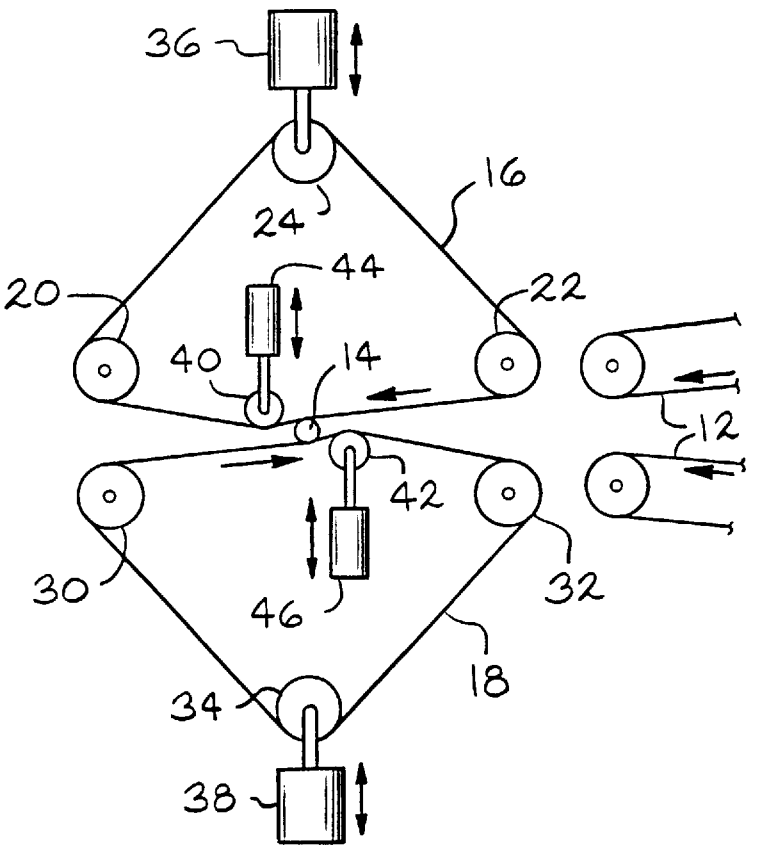
FIG. 2 is a schematic view in elevation of a portion of the apparatus of FIG. 1, with the deflector roller engaged, prior to the beginning of the roll-up process.

Mounted within the path of travel of the two belts are upper and lower deflector rollers 40 and 42, respectively. These are mounted for movement into and out of contact with the belts, and are adapted with means, such as pneumatic cylinders 44 and 46, respectively, for moving them into engagement with the belts. As shown in FIG. 2, engagement of upper deflector roller 40 causes the upper belt to deviate from the straight path between upper belt rollers 20 and 22. Engagement of the deflector rollers also increases the tension in the belts, and also applies additional pressure on the insulation blanket being rolled up. As shown in FIG. 3, this deviation in the straight line path causes the upper belt to increase the angle of wrap around insulation roll 50 (shown in FIG. 4) which is being rolled up on the mandrel. Similarly, engagement of lower deflector roller 42 causes the lower belt to deviate from the straight path between lower belt rollers 30 and 32, and increase the angle of wrap around the insulation roll.

Figure 4:
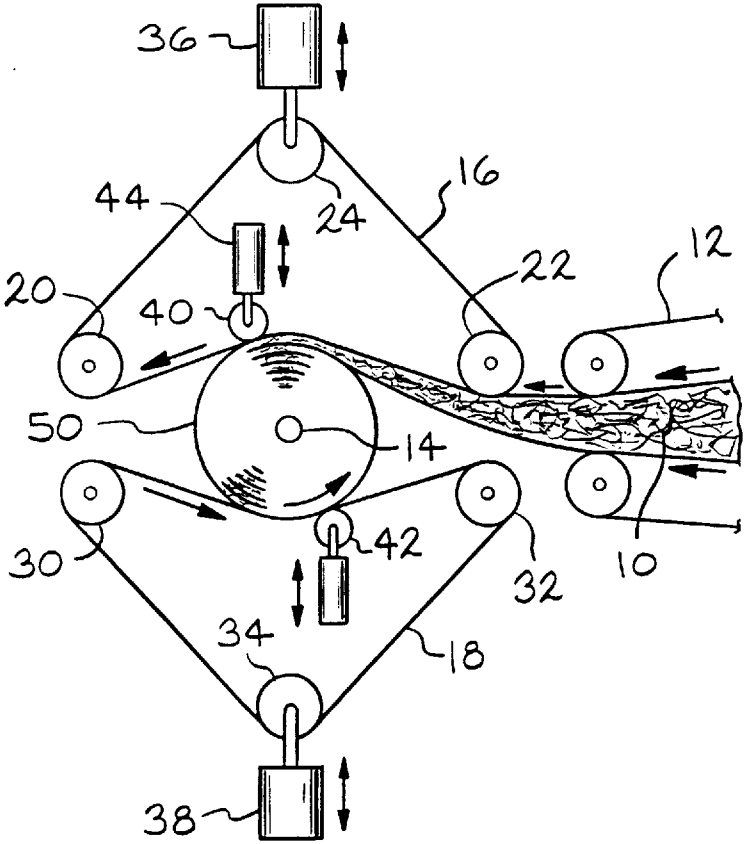
FIG. 4 is a view similar to FIG. 3, in which the roll is nearly completed.

As shown in FIG. 4, during the later stages of the roll up process the upper and lower deflector rollers can be retracted out of engagement with the belts, primarily because the angle of wrap of the belts is increased by virtue of the increase in size of the roll. During the startup phase of the operation, the deflector rollers are engaged before the leading end of the insulation blanket is attached to the mandrel. Although the deflector rollers can be engaged during the entire packaging cycle, preferably the deflector rollers are disengaged after about a quarter of the insulation blanket is wound up on the mandrel.

Figure 5:
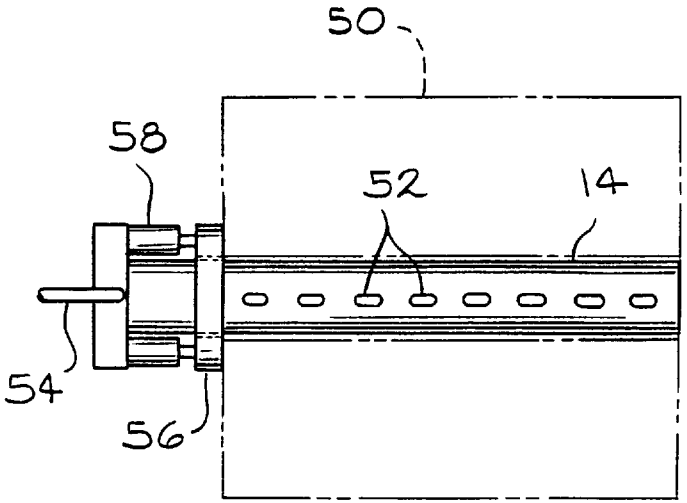
FIG. 5 is a schematic view in elevation of the mandrel and ejector ring of the apparatus shown in FIG. 1.

As shown in FIG. 5, the mandrel can be adapted with apertures or air ports 52 which can be operatively connected to a source of vacuum or air pressure, not shown, via conduit 54. During startup phase of the roll up process, the air ports are preferably connected to a source of negative gauge pressure to facilitate attachment of the beginning end of the insulation blanket to the mandrel. The startup phase of the process will be facilitated by rotatably driving the mandrel. After the insulation blanket is completely rolled up, the air ports can be connected to a source of positive gauge air pressure, not shown, to enable the roll to more easily be slid off or removed from the mandrel. It has been found that the insulation roll can be removed even without lubrication or the use of a core tube. Ejection of the roll from the mandrel is preferably accomplished by the movement of ejector ring 56 along the mandrel. The ejector ring can be operated by any means, such as pistons 58. It is to be understood that any means suitable for removing the completed roll from the mandrel can be used. The rolls can also be removed by hand. Preferably, a wrapper or other suitable packaging or restraint material is applied to the roll before the pressure from the upper and lower belts is removed. By using two belts (the upper and the lower) the wrapper can be inserted and rolled up around the completed insulation roll while the insulation roll is still within the confines of the upper and lower belts.

Figure 6:
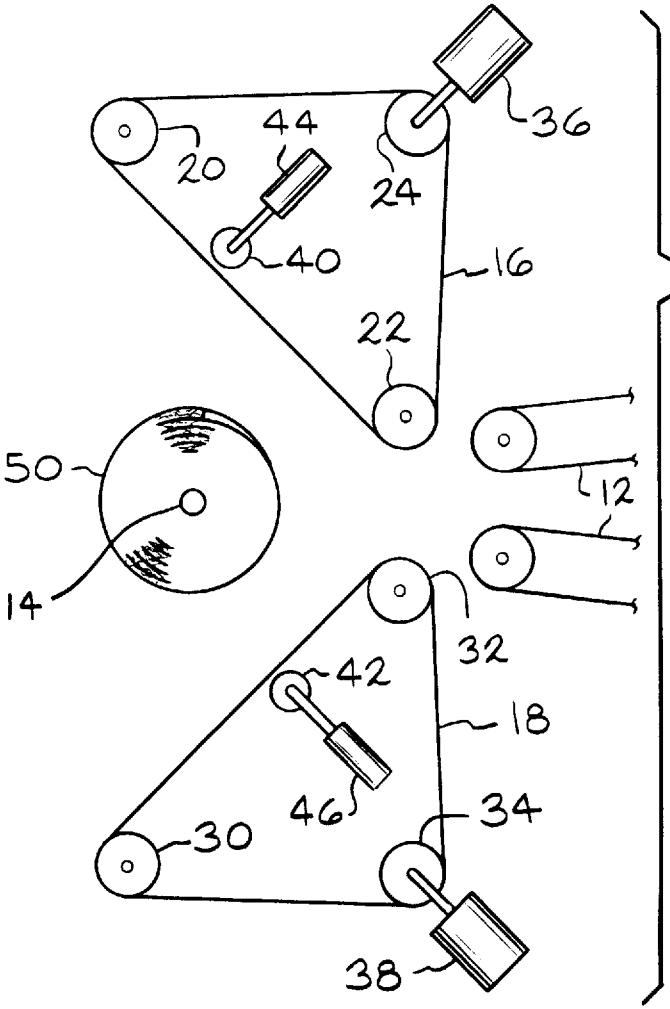
FIG. 6 is a view similar to FIG. 4, in which the upper and lower belts have been removed from engagement with the completed roll to remove the roll from the mandrel.

The removal of the rolls from the mandrel will be facilitated if the upper and lower belts are mounted for disengagement from the mandrel and roll. Preferably the upper and lower belts are mounted for an open jaw type movement, as shown in FIG. 6, to enable easy removal of the roll. Preferably, a wrapper or other suitable packaging material is applied to the roll before the pressure from the upper and lower belts is removed.

Figure 7:
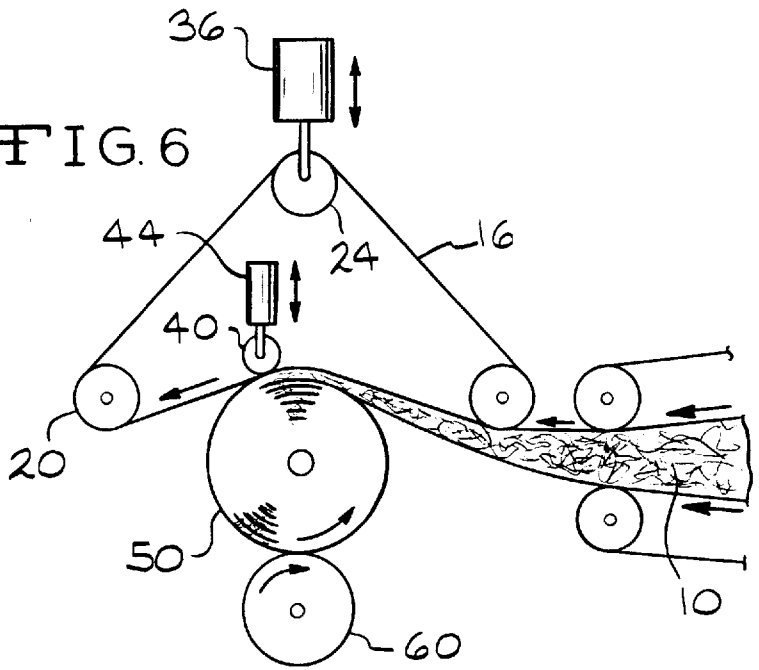
FIG. 7 is a schematic view in elevation of an alternative apparatus having an upper belt and a lower nip roll for packaging compressible insulation material according to the invention.

As shown in FIG. 7, the invention can be carried out using just one belt and a backup device, such as backup roller 60. The backup roller provides a surface upon which the package can be pressed by the upper belt. The backup roller can be mounted for vertical movement to allow for increases in package size as the insulation material is being rolled up. Two or more backup rollers could also be employed.

It will be evident from the foregoing that various modifications can be made to this invention. Such, however, are considered as being within the scope of the invention.

Industrial Applicability

This invention will be found useful in packaging compressible materials of the type used for thermal and acoustical insulation.

We claim:

1. The method of packaging compressible insulation material comprising:

feeding insulation material into contact with a mandrel;

rolling up the insulation material on the mandrel to form an insulation roll;

applying pressure on the insulation material, during the rolling of the insulation material, with a pair of opposed belts which are adapted to contact the roll being formed with an increasing angle of wrap as the diameter of the roll increases;

increasing tension on the belts as the diameter of the roll increases in order to maintain a substantially constant pressure on the insulation material, and moving a deflector roller, which engages at least one of the belts, during the rolling of the insulation material, to increase the angle of wrap of the belt around the insulation material as the diameter of the roll increases.

2. The method of claim 1 in which the belts are mounted for travel around at least three rollers, one of the rollers is mounted for movement, and the tension in the belts is controlled by controlling the movement of said one of the rollers.

3. The method of claim 2 in which the tension is increased from an initial tension to a final tension which is within the range of from about 1.2 to about 2.0 times the initial tension as the diameter of the roll increases.

4. The method of claim 1 comprising disengaging the deflector roller from the belt after less than one-half of the length of the time period during which the insulation material is being rolled up.

5. The method of claim 1 in which the mandrel is adapted with apertures, and including the step of applying a negative gauge pressure to the apertures to facilitate attachment of the beginning end of the insulation material to the mandrel.

6. The method of claim 1 in which the mandrel is adapted with apertures, and including the step of applying a positive gauge pressure to the apertures to facilitate removal of the insulation roll from the mandrel.

7. The method of packaging compressible fibrous insulation material comprising:

feeding fibrous insulation material into contact with a mandrel;

rolling up the insulation material on the mandrel to form an insulation roll;

applying pressure on the insulation material, during the rolling of the insulation material, with a pair of opposed belts which are adapted to contact the roll being formed with an increasing angle of wrap as the diameter of the roll increases, moving a deflector roller, which engages at least one of the belts, during the rolling of the insulation material, to increase the angle of wrap of the belt around the insulation material as the diameter of the roll increases, and increasing tension on the belts as the diameter of the roll increases in order to maintain a substantially constant pressure on the insulation material.

8. The method of claim 7 comprising disengaging the deflector roller from the belt after less than one-half of the length of the time period during which the insulation material is being rolled up.

9. The method of claim 7 in which the mandrel is adapted with apertures, and including the step of applying a negative gauge pressure to the apertures to facilitate attachment of the beginning end of the insulation material to the mandrel.

10. The method of claim 7 in which the mandrel is adapted with apertures, and including the step of applying a positive gauge pressure to the apertures to facilitate removal of the insulation roll from the mandrel.

11. The method of packaging compressible insulation material comprising:

feeding insulation material into contact with a mandrel;

rolling up the insulation material on the mandrel to form an insulation roll;

applying pressure on the insulation material, during the rolling of the insulation material, with a traveling belt which is adapted to contact the roll being formed with an increasing angle of wrap as the diameter of the roll increases;

moving a deflector roller, which engages the belt, during the rolling of the insulation material, to increase the angle of wrap of the belt around the insulation material as the diameter of the roll increases, and increasing tension on the belt as the diameter of the roll increases in order to maintain a substantially constant pressure on the insulation material.

12. The method of claim 11 in which the tension is increased from an initial tension to a final tension which is within the range of from about 1.2 to about 2.0 times the initial tension as the diameter of the roll increases.

13. Apparatus for packaging compressible insulation material comprising:

a mandrel mounted for rotation, and adapted to roll up insulation material into a roll;

a pair of opposed belts adapted to contact the roll being formed on the mandrel to apply pressure to the roll, the belts being positioned so that they contact the roll being formed with an increasing angle of wrap as the diameter of the roll increases;

a deflector roller mounted for engagement with at least one of the belts to increase the angle of wrap of the belt around the roll of insulation material being formed on the mandrel, and means for increasing tension on the belts as the diameter of the roll increases in order to maintain a substantially constant pressure on the insulation material.

14. The apparatus of claim 13 in which the mandrel is adapted with apertures which are operatively connected to a source of negative gauge pressure to facilitate attachment of the beginning end of the insulation material to the mandrel.

15. The apparatus of claim 13 in which the mandrel is adapted with apertures which are operatively connected to a source of positive gauge pressure to facilitate removal of the insulation roll from the mandrel.

* * * * *